US007503999B2

(12) United States Patent
Tsuura et al.

(10) Patent No.: US 7,503,999 B2
(45) Date of Patent: Mar. 17, 2009

(54) MEMBER FOR PRODUCING CASTINGS

(75) Inventors: Tokuo Tsuura, Haga-gun (JP); Hiroaki Kobayashi, Haga-gun (JP); Yoshimasa Takagi, Haga-gun (JP); Shigeo Nakai, Toyohashi (JP); Tokihito Sono, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/534,798

(22) PCT Filed: Nov. 11, 2003

(86) PCT No.: PCT/JP03/14314

§ 371 (c)(1),
(2), (4) Date: Oct. 13, 2005

(87) PCT Pub. No.: WO2004/043627

PCT Pub. Date: May 27, 2004

(65) Prior Publication Data

US 2006/0130987 A1 Jun. 22, 2006

(30) Foreign Application Priority Data

Nov. 13, 2002 (JP) ..... 2002-329787
Nov. 10, 2003 (JP) ..... 2003-379397

(51) Int. Cl.
*B22C 9/00* (2006.01)
*D21H 13/36* (2006.01)
*B22D 37/00* (2006.01)

(52) U.S. Cl. ..... 162/118; 162/141; 162/164.1; 162/181.6; 428/34.5; 428/34.7; 138/154; 164/349; 164/364

(58) Field of Classification Search ..... 428/34.2, 428/34.5, 34.7; 162/118, 141, 164.1, 181.6; 138/154; 164/418, 437, 349, 364
See application file for complete search history.

(56) References Cited

U.S. PATENT DOCUMENTS 1,925,584 A 9/1933 Fisher (Continued)

FOREIGN PATENT DOCUMENTS

BE 713368 8/1968

(Continued)

OTHER PUBLICATIONS

Microfilm of the specification and drawings annexed to the request of Japanese Utility Model Application No. 17292/1979 (Laid-open No. 116751/1980) (Kabushiki Kaisha Yoshida Tekkosho), Apr. 18, 1989.

Microfilm of the specification and drawings annexed to the request of Japanese Utility Model Application No. 154632/1987 (Laid-open No. 60742/1989) Kamogawa Kogyo Kabushiki Kaisha), Apr. 18, 1989.

CD-ROM of the specification and drawings annexed to the request of Japanese Utility Model Application No. 37490/1993 (Laid-open No. 86843/1994) (Kiyoshi Kita), Dec. 20, 1994.

*Primary Examiner*—Eric Hug
*Assistant Examiner*—Dennis Cordray
(74) *Attorney, Agent, or Firm*—Birch, Stewart, Kolasch & Birch, LLP

(57) ABSTRACT

A part for casting obtained by converting base paper for paper tubing into a tube and containing an organic fiber, an inorganic fiber, and a binder. The part is preferably obtained by winding the base paper into tubing. The part preferably contains 10 to 70 parts by weight of the organic fiber, 1 to 80 parts by weight of the inorganic fiber, 10 to 85 parts by weight of the binder. The organic fiber is preferably pulp fiber.

10 Claims, 1 Drawing Sheet

U.S. PATENT DOCUMENTS

| | | | | |
|---|---|---|---|---|
| 2,006,392 | A | 7/1935 | Greider et al. | |
| 2,269,455 | A | 1/1942 | Hagemeyer | |
| 2,971,877 | A | 2/1961 | Arledter | |
| 3,006,805 | A | 10/1961 | Waggoner | |
| 3,236,719 | A | 2/1966 | Waggoner | |
| 3,418,203 | A | 12/1968 | Asunmaa | |
| 3,773,513 | A | 11/1973 | MacClaren | |
| 3,844,337 | A | 10/1974 | Bessett et al. | |
| 4,069,859 | A * | 1/1978 | Nagai et al. | 164/56.1 |
| 4,081,168 | A | 3/1978 | Atterbury et al. | |
| 4,251,320 | A | 2/1981 | Cederqvist et al. | |
| 4,256,801 | A * | 3/1981 | Chuluda | 442/322 |
| 4,291,781 | A | 9/1981 | Niguchi et al. | |
| 4,356,994 | A | 11/1982 | Thornton | |
| 4,789,430 | A | 12/1988 | Fredenucci | |
| 4,923,665 | A | 5/1990 | Andersen et al. | |
| 4,981,166 | A * | 1/1991 | Brown et al. | 164/5 |
| 5,205,340 | A | 4/1993 | Brown et al. | |
| 5,272,006 | A * | 12/1993 | Maine | 428/396 |
| 5,569,320 | A | 10/1996 | Sasaki et al. | |
| 5,611,848 | A | 3/1997 | Sasaki et al. | |
| 5,830,548 | A * | 11/1998 | Andersen et al. | 428/36.4 |
| 5,906,712 | A | 5/1999 | Asami et al. | |
| 5,983,268 | A | 11/1999 | Freivald et al. | |
| 5,989,390 | A * | 11/1999 | Lee | 162/141 |
| 5,997,785 | A | 12/1999 | Skjelmose | |
| 6,264,045 | B1 * | 7/2001 | Wilson et al. | 210/491 |
| 6,278,448 | B1 | 8/2001 | Brown et al. | |
| 6,331,358 | B1 | 12/2001 | Kitahara et al. | |
| 6,335,387 | B1 | 1/2002 | Twardowska et al. | |
| 6,488,811 | B1 | 12/2002 | Dong | |
| 6,521,085 | B2 | 2/2003 | Kumamoto et al. | |
| 6,533,897 | B2 | 3/2003 | Wang et al. | |
| 6,540,874 | B1 * | 4/2003 | Ling-Chen | 162/138 |
| 6,616,802 | B1 | 9/2003 | Kinsley et al. | |
| 6,616,804 | B2 | 9/2003 | Foster et al. | |
| 6,733,628 | B2 | 5/2004 | Dinwoodie et al. | |
| 6,841,041 | B2 | 1/2005 | Kumamoto et al. | |
| 6,918,997 | B2 | 7/2005 | Goto et al. | |
| 7,067,041 | B2 | 6/2006 | Tsuura et al. | |
| 7,077,933 | B2 | 7/2006 | Otani et al. | |
| 7,297,232 | B2 | 11/2007 | Tsuura et al. | |
| 2001/0040016 | A1 | 11/2001 | Kumanoto et al. | |
| 2002/0174963 | A1 | 11/2002 | Wang et al. | |
| 2002/0189776 | A1 | 12/2002 | Kumamoto et al. | |
| 2003/0029591 | A1 | 2/2003 | Otani et al. | |
| 2003/0121635 | A1 | 7/2003 | Kumamoto et al. | |
| 2003/0145968 | A1 | 8/2003 | Kumamoto et al. | |
| 2003/0150582 | A1 | 8/2003 | Tsuura et al. | |
| 2003/0150583 | A1 | 8/2003 | Goto et al. | |
| 2003/0209337 | A1 | 11/2003 | Nonomura | |
| 2004/0011489 | A1 | 1/2004 | Kimbara et al. | |
| 2004/0041305 | A1 | 3/2004 | Tsuura et al. | |
| 2004/0045690 | A1 | 3/2004 | Eto et al. | |
| 2004/0069429 | A1 | 4/2004 | Tsuura et al. | |
| 2006/0005937 | A1 | 1/2006 | Sakaguchi et al. | |
| 2006/0130987 | A1 | 6/2006 | Tsuura et al. | |

FOREIGN PATENT DOCUMENTS

| | | | |
|---|---|---|---|
| CN | 1041715 | A | 5/1990 |
| CN | 1167020 | A | 12/1997 |
| DE | 2632880 | | 2/1977 |
| DE | 3039935 | A1 | 5/1982 |
| EP | 0 062 193 | A1 | 10/1982 |
| EP | 1 488 871 | A1 | 12/2004 |
| EP | 1577034 | A1 | 9/2005 |
| FR | 2085544 | | 12/1971 |
| FR | 2 246 516 | | 5/1975 |
| FR | 2475970 | | 8/1981 |
| GB | 2 047 766 | A | 12/1980 |
| GB | 2047766 | A | 12/1980 |
| JP | 43-13441 | | 6/1968 |
| JP | 49-125222 | | 11/1974 |
| JP | 50-77415 | A | 6/1975 |
| JP | 50-20545 | | 7/1975 |
| JP | 51-1286 | Y2 | 1/1976 |
| JP | 53-48026 | | 5/1978 |
| JP | 57-177846 | A | 1/1982 |
| JP | 57-190747 | A | 11/1982 |
| JP | 59-165743 | U | 11/1984 |
| JP | 62-89758 | A | 4/1987 |
| JP | 63-295037 | A | 12/1988 |
| JP | 1-60742 | U | 4/1989 |
| JP | 1-262041 | A | 10/1989 |
| JP | 1-278935 | A | 11/1989 |
| JP | 1-1278935 | A | 11/1989 |
| JP | 5-31128 | A | 2/1993 |
| JP | 6-327704 | A | 11/1994 |
| JP | 08-267222 | A | 10/1996 |
| JP | 9-253792 | A | 9/1997 |
| JP | 11-254091 | | 9/1999 |
| JP | 11-254091 | A | 9/1999 |
| JP | 2004-195547 | A | 7/2004 |
| KR | 0128008 | B1 | 4/1998 |
| WO | 5-31128 | A | 2/1993 |
| WO | 00/58556 | A1 | 10/2000 |
| WO | 01/64527 | A1 | 9/2001 |
| WO | 3076104 | A1 | 9/2003 |
| WO | 2004-043627 | A1 | 5/2004 |

* cited by examiner

MEMBER FOR PRODUCING CASTINGS

DESCRIPTION

1. Technical Field

The present invention relates to a part useful for casting that is obtained by converting base paper for paper tubing into a tube, a process of producing the part, and a casting production method using the part.

2. Background Art

Casting production generally involves forming a casting mold having a cavity (and, if necessary, a core) from casting sand, forming a pouring cup, a sprue, a channel and a gate to make a passage leading to the cavity through which molten metal is fed to the cavity (these parts will hereinafter be inclusively referred to as a gating system), and additionally forming a vent, a feeder, and a flow-off which lead to the outside. The gating system, vent, feeder, and flow-off are formed integrally with the mold, or the gating system is assembled from parts separately made of refractories such as earthenware and brick.

Where a mold and a gating system, etc. are integrally formed, it is difficult to design the gating system in a intricate configuration, and sand enters molten metal easily. Where, on the other hand, parts made of refractories are used to set up the gating system, etc., molten metal is liable to experience a temperature drop on contact with the gating system, etc. Moreover, assembly of the refractory parts into a gating system, etc. is troublesome, involving cutting refractories with a high-speed cutter, e.g., a diamond cutter, and joining the cut pieces by tape winding. In addition, after filling, the refractory gating system, etc. break due to thermal shock and the like to produce a large quantity of industrial waste, the disposal of which is labor intensive. In general, a gating system made of refractories is inconvenient to handle.

The technique disclosed in JP-A-U-1-60742 (Japanese utility model laid-open publication) is among known methods addressing these problems. According to this technique, a heat-insulating material obtained by molding a slurry comprising organic or inorganic fiber and an organic binder is used to make parts forming a gating system in place of refractories.

However, a gating system, etc. molded from a combination of organic fiber and an organic binder largely shrinks due to thermal decomposition on feeding molten metal, which can lead to leakage of the molten metal from the gating system, etc. Where inorganic fiber and an inorganic binder are combined, it is difficult to mold into a heat-insulating material having a three-dimensional shape (e.g., a hollow shape), resulting in a failure to make a gating system, etc. matching various cavity shapes.

It is also known to use a paper core for casting produced from a material having a reduced cellulose fiber content by mixing inorganic powder and/or inorganic fiber into cellulose fiber (see, e.g., JP-A-9-253792). The paper core can be produced with suppressed shrinkage on drying. By use of this core, generation of gas or tar-like polymers from cellulose fiber during casting can be suppressed. As a result, casting deflects are prevented, and casting workability is improved.

Notwithstanding these advantages, the paper core according to that technique contains no binder and is therefore not suited for use in a gating system, etc. applied to various cavity shapes.

Accordingly an object of the present invention is to provide a part for use in the production of castings which is less liable to thermal shrinkage due to thermal decomposition, easy to handle, and configured to constitute a gating system, etc. applicable to various cavity shapes, a process of producing the part, and a casting production method using the part.

DISCLOSURE OF THE INVENTION

The present invention accomplishes the above object by providing a part for casting obtained by converting base paper for paper tubing into a tube and containing an organic fiber, carbon fiber, and a binder.

The present invention also provides a method of producing a casting using a part for casting containing an organic fiber, carbon fiber, and a binder. The part is disposed in casting sand.

The present invention also provides a process of producing the part for casting according to the invention. The process includes the steps of making base paper for paper tubing by papermaking using a slurry containing at least the organic fiber and the carbon fiber, converting the base paper into a paper tube, and impregnating the paper tube with the binder.

BEST MODE FOR CARRYING OUT THE INVENTION

Figure 1:
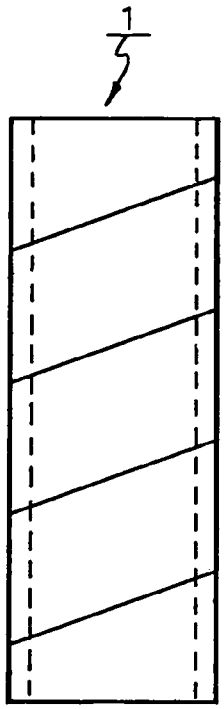
FIG. 1 schematically shows an embodiment of the invention in which a part for casting is used as a sprue.

The present invention will be described with reference to its preferred embodiments.

The part for casting according to the present invention is obtained by converting base paper for paper tubing into a tubular form and contains an organic fiber, carbon fiber, and a binder. The part for casting is preferably formed by winding base paper. The base paper can be wound with or without an overlap between adjacent turns. A plurality of base papers may be wound one on top of another. A long, cylindrical part for casting is preferably formed by spirally winding a strip of base paper. The part for casting of the invention may be formed otherwise than winding. For example, a rectangular base paper for paper tubing is curled into a cylinder, and the opposing two sides are joined. Taking the strength required of a part for casting into consideration, the thickness of the base paper for paper tubing is preferably 0.4 to 2 mm, more preferably 0.7 to 1.5 mm.

The organic fiber functions mainly to form the skeleton of the part. On casting, part of the whole of the organic fiber decomposes by the heat of molten metal to leave voids in the part after casting production.

The organic fiber includes paper fiber and fibrillated synthetic fiber or regenerated fibers (e.g., rayon fiber) or etc. These fibers are used either individually or as a mixture of two or more thereof. Preferred of them is paper fiber for the following reasons. Paper fiber is easily and stably supplied and therefore contributory to reduction of production cost. Paper fiber provides sufficient strength after dewatering and drying.

The paper fiber includes not only wood pulp but non-wood pulp, such as cotton pulp, linter pulp, bamboo, and straw. Virgin pulp or used paper (recycled) pulp can be used either alone or in combination thereof. From the standpoint of ease and stability of supply, environmental conservation, reduction of production cost and etc., used paper pulp is preferred.

It is preferred for the organic fiber to have an average length of 0.8 to 2.0 mm, more preferably 0.9 to 1.8 mm, from the viewpoint of surface smoothness, impact strength, thickness uniformity and the like of the resulting part.

The content of the organic fiber in the part for casting of the present invention is preferably 10 to 70 parts by weight, more preferably 20 to 60 parts by weight, in view of ease of conversion into a desired part, for securing strength as part for casting, for reducing gas generation and etc. The unit "part(s) by weight" as used throughout the description is based on 100 parts by weight of the total amount of an organic fiber, carbon fiber, and a binder.

The carbon fiber serves mainly to form the skeleton of the part for casting similarly to the above-described organic fiber. On casting molten metal, it does not decompose nor burn even with the heat of the molten metal and continues serving to retain the original shape of the part.

When in using an organic binder as a binder, carbon fiber maintains high strength even in high temperatures, and is preferred for reducing thermal shrinkage accompanying carbonization of the organic binder.

The carbon fiber preferably has an average length of 0.2 to 10 mm, more preferably 0.5 to 8 mm, in order to secure good drainage in papermaking process, processability of the resulting base paper for paper tubing, and the like.

The content of the carbon fiber is preferably 1 to 80 parts by weight, more preferably 7 to 40 parts by weight, taking into consideration strength as a part for casting, processability of the resulting base paper for paper tubing, and the like.

The weight ratio of the carbon fiber to the organic fiber (i.e., carbon fiber content/organic fiber content) is preferably 1 to 60, more preferably 2 to 30, in the case of using carbon fiber for ease of conversion as a part for casting, securing strength and the like.

The binder includes organic ones and inorganic ones as hereinafter described. The organic and the inorganic binders can be used either individually or as a mixture thereof.

The organic binders include such kinds as those serving to bind the organic fiber and the carbon fiber of the part for casting and those which enhance the strength of the part and, on casting, carbonize by the heat of molten metal to maintain the strength of the part.

The organic binders include thermosetting resins, such as phenol resins, epoxy resins, and furan resins. Preferred of them are phenol resins in view of reduced generation of combustible gas, resistance to burning, a high carbon residue content after thermal decomposition (carbonization) and the like. Of the phenol resins more preferred are resol type ones that require no curing agent and can impregnate into a part for casting of the present invention.

The inorganic binders include those capable of binding the organic fiber and the carbon fiber of the part for casting, those which do not thermally decompose on casting thereby reducing generation of combustion gas or flame, those effective in inhibiting carburizing on casting and etc.

The inorganic binders include compounds mainly comprising $SiO_2$, such as colloidal silica, obsidian, mullite, perlite, ethyl silicate, and water glass. Among them colloidal silica is preferred in view of its independent utility, ease of application and the like, and obsidian is preferred for prevention of carburizing. The inorganic binders can be used either individually or as a mixture of two or more thereof.

The binder content (on a solid basis) preferably ranges 10 to 85 parts by weight, more preferably 20 to 80 parts by weight, for securing strength as a part for casting, ease of conversion, and the like.

In using a binder other than obsidian, the content of the binder in the part for casting is preferably 10 to 70 parts by weight, more preferably 20 to 50 parts by weight. In using obsidian as a binder, it is preferably used in an amount of at least 20 parts by weight based on the total binder content. The binder may consist solely of obsidian.

Two or more kinds of binders different in melting point can be used in combination. In order to retain the shape of the parts in an temperature range of from ambient temperature (before casting) to high temperature (during casting), to prevent carburizing during casting and the like, it is preferred to use a low-melting binder and a high-melting binder in combination. In this case, the low-melting binder includes clay, water glass, obsidian or etc., and the high-melting binder includes the above-recited compounds mainly comprising $SiO_2$, mullite, wollastonite, $Al_2O_3$ and etc.

The part for casting according to the present invention can contain a paper strengthening agent. When a paper tube is impregnated with a binder, the paper strengthening agent added reduces a swell of the paper tube.

A preferred amount of the paper strengthening agent to be added is 1% to 20%, more preferably 2% to 10%, based on the weight of the organic fiber.

The paper strengthening agent includes polyvinyl alcohol, carboxymethyl cellulose (CMC), Kymene (polyamideamine-epichlorohydrin resin) and etc.

The part for casting according to the present invention can further contain other additives such as a flocculant and a colorant.

The thickness of the part for casting is subject to variation according to where it is applied. For example, the portion which comes into contact with molten metal preferably has a thickness of 0.2 to 2 mm, more preferably 0.4 to 1.5 mm, for securing strength required of a part for casting while securing air permeability, reducing the production cost, and the like.

To secure strength, the part for casting preferably has a compressive strength of 10 N or higher, more preferably 30 N or higher before use in casting.

It is preferred for the part before use in casting to have a water content of not more than 10% by weight, more preferably 8% by weight or less, in order to minimize gas generation accompanying thermal decomposition of the organic binder.

The density of the part for casting is preferably 0.5 g/cm$^3$ or higher, more preferably 0.6 to 1.2 g/cm$^3$, from the standpoint of strength, light weight, processability, and the like.

The process of producing the part for casting will then be described.

A slurry is prepared by dispersing the organic and the carbon fibers and the binder in a prescribed dispersing medium. It is possible to exclude the binder from the composition of the slurry, if desired, because the binder may be incorporated by impregnation into base paper for paper tubing obtained by papermaking, dewatering and drying or into a paper tube formed from the base paper.

The dispersing medium includes water, white water, solvents such as ethanol and methanol, and etc. Water is particularly preferred in view of stability in papermaking and dewatering, stability of quality of the resulting base paper, cost, ease of handling, and the like.

The slurry preferably contains the organic fiber in an amount of 0.1% to 3% by weight, more preferably 0.5% to 2% by weight, based on the dispersing medium in view of surface smoothness, thickness uniformity, etc. of the resulting base paper for paper tubing.

If desired, the slurry can contain additives including a flocculant, an antiseptic and etc.

The slurry is then converted into base paper for paper tubing by a papermaking process.

Papermaking can be carried out by any technique selected from, for example, continuous papermaking methods using a cylinder paper machine, a Fourdrinier paper machine, a short-wire paper machine or a twin-wire paper machine, and batch-wise papermaking methods including manual papermaking.

In order for the base paper for paper tubing to keep the shape retention and mechanical strength after papermaking, the base paper for paper tubing is dewatered to reduce its water content (water content by weight, hereinafter the same) preferably to 70% or smaller, more preferably to 60% or smaller. Dewatering of the base paper after papermaking can be conducted by, for example, suction, blowing pressurized air or pressing with a pressure roll or a pressure plate.

The dewatered base paper for paper tubing is forwarded to a drying step. Any means for drying that has conventionally been used to dry paper can be used in the drying step.

The resulting base paper for paper tubing is slit into strips of prescribed width, which are wound in a helix pattern to produce a spiral-wound paper tube having a multilayer structure.

When necessary, a part or the whole of the resulting paper tube is impregnated with a binder. Binders to be infiltrated into the paper tube include resol type phenol resins, colloidal silica, ethyl silicate, water glass and etc.

Where the paper tube is impregnated with a binder, it is possible to omit addition of a binder to the slurry.

Finally, the paper tube is dried by heating at a predetermined temperature to complete production of a paper tube. It is possible that conversion of base paper into a paper tube is preceded by impregnation of the base paper with a binder.

The part for casting according to the present invention is useful as a sprue as in the embodiment shown in FIG. 1, in which numeral 1 indicates a sprue.

The casting production method of the present invention will be described based on an embodiment in which the above-mentioned sprue is used.

Figure 2:
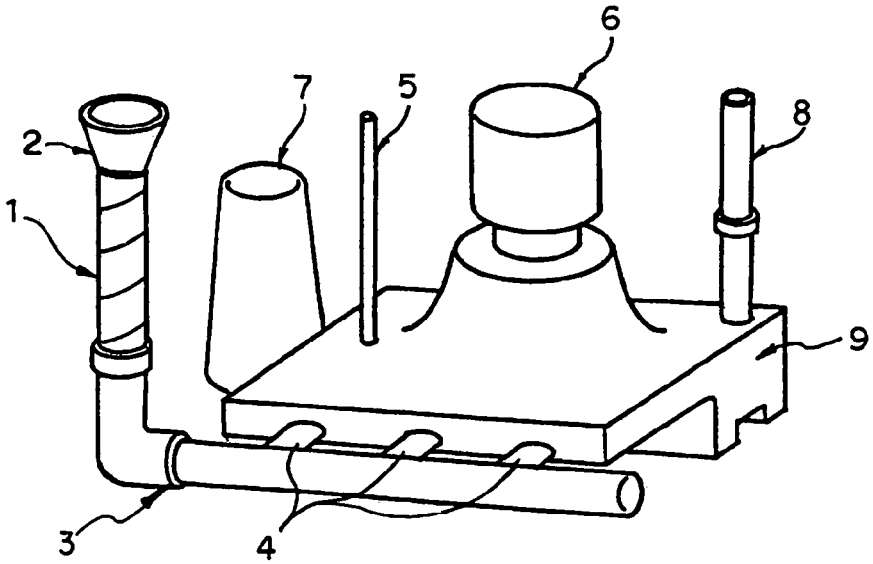
FIG. 2 is a perspective schematically showing a configuration in which the sprue of the embodiment shown in FIG. 1 is arranged together with other parts for casting such as a mold for casting.

As shown in FIG. 2, parts for casting are assembled according to a prescribed configuration. The parts for casting consist of a gating system including the sprue 1, a pouring cup 2, a channel 3 (inclusive of an elbow or L-shaped connector), gates 4 and etc.; a vent 5; top and side feeders 6 and 7; a flow-off 8; and a mail mold 9 having a cavity (not shown) corresponding to the contour of a casting to be made.

The assembled parts for casting are buried in casting sand (not shown). Molten metal having a prescribed composition is fed to the cavity of the mold 9 through the gating system. Where the part for casting contains an organic binder, the binder and the organic fiber thermally decompose and carbonize by the heat of the molten metal, but the strength required as a part for casting is maintained. Because the inorganic fiber suppresses thermal shrinkage of the part due to the thermal decomposition, the part is prevented from cracking or flowing away together with the molten metal so that incorporation of casting sand and the like into the molten metal does not occur. After the casing mold is broken to take out the casting product, it is easy to remove the part from the mold because the organic fiber has decomposed thermally.

Casting sands conventionally employed for casting can be used without particular restriction.

After completion of mold filling, the mold is cooled to a prescribed temperature. The casting sand is removed, and the casting is subjected to blasting. Unnecessary parts such as the gating system parts are also removed. If needed, the casing is finished by trimming and the like to complete casting production.

As described, the part for casting of the aforementioned embodiment and a casting production method using the part offer the following advantages. The organic fiber decomposes by the heat of molten metal to leave voids inside of the part for casting, while the carbon fiber and the binder maintain strength required of a part for casting. After destruction of the casting mold, the part can easily be separated and removed. In other words, the use of the organic fiber, carbon fiber, and binder provides a part for casting that retains strength required of a part for casting during the casting mold formation and casting and reduces its strength in destroying the mold. Accordingly, the method of casting production of the present invention simplifies disposal of used parts for casting and greatly reduces the waste itself as compared with the conventional casting method using the parts made of refractories.

Since the part for casting according to the present invention contains an organic fiber, carbon fiber, and a binder, it produces a smaller amount of flame on filling than a part for casting made solely of an organic fiber. The part for casting of the present invention is prevented from reducing its strength due to combustion of the organic fiber, cracking due to thermal shrinkage accompanying thermal decomposition (carbonization) of the organic binder and the like. As a result, the defect of products due to contamination of casting sand into the molten metal can be avoided.

Having air permeability, the part of the present invention allows gas generated on pouring to escape toward the casting sand side. Production of defective castings attributed to so-called blow holes (or pin holes) and the like is thus prevented.

The part for casting according to the present invention is lightweight and easy to cut with a simple tool and is therefore excellent in handling properties.

The present invention is not limited to the above-described embodiments, and various changes and modifications can be made therein without departing from the spirit and scope thereof.

The part for casting according to the present invention can be used as not only the sprue 1 as in the above-described embodiment but the pouring cup, the runner, the gate, the vent, the feeders, and the flow-off (numerals 2 to 8) which are shown in FIG. 2.

The method for casting production according to the present invention is applicable to not only cast iron but casting of nonferrous metals, such as aluminum and its alloys, copper and its alloys, nickel, and lead.

The present invention will now be illustrated in greater detail with reference to Example.

EXAMPLE 1

A slurry shown below was converted into paper, dewatered, and dried to obtain base paper for paper tubing having a thickness of 1 mm and a basis weight of 440 g/m$^2$. The base paper was converted into a paper tube in the manner described below to obtain a sprue (a part for casting) weighing about 30 g and having the physical properties shown below.

Preparation of Slurry

The organic fiber and the carbon fiber described below were dispersed in water to prepare an about 1% slurry (a total weight of the organic and the carbon fibers was 1% by weight with respect to water). The binder and the flocculant shown below were added to the slurry to prepare a stock. The mixing weight ratio of the organic fiber, carbon fiber and binder was as shown below.

Composition of Slurry

Organic fiber: recycled newspapers; average fiber length: 1 mm; freeness (CSF, hereinafter the same): 150 cc Carbon fiber: Carbon fiber (Torayca chopped fiber, available from Toray Industries, Inc.; fiber length: 3 mm) was beaten.

The organic fiber and the carbon fiber were mixed into a slurry at a weight ratio of 26:8.

The slurry was adjusted to have a freeness of 300 cc.

Inorganic binder: obsidian (Nice Catch, available from Kinsei Matec Co., Ltd.)

Organic binder: epoxy phenol resin (available from Sumitomo Bakelite Co., Ltd.)

Flocculant: polyacrylamide coagulant (A110, available from Mitsui Cytec Ltd.)

Dispersing medium: water

Organic fiber:carbon fiber:inorganic binder:organic binder=26:8:48:18 (by weight)

Papermaking Conditions

The slurry was converted into a wet paper sheet on a tilted short-wire paper machine at a line speed of 1.5 m/min.

Dewatering and Drying Conditions

The paper sheet was held in between two felt pads and dewatered by suction and then passed between heating rolls of 120° C. at a line speed of 1.5 m/min to reduce the water content to 5% by weight or less.

Step of Converting Into Paper Tube

The resulting base paper was slit to obtain strips of five widths: 54.4 mm, 54.8 mm, 55.2 mm, 55.6 mm, and 56.0 mm. The strip of the smallest width was spirally wound into a tube. The other strips of four widths were spirally wound around the tube in succession in ascending order of width to obtain a paper tube having an inner diameter of about 30 mm and a density of 1.0 g/cm$^3$. The strips were adhered to each other with an adhesive.

Steps of Drying and Curing

The paper tube was dried in a drying oven at 200° C. for about 60 minutes to obtain a sprue.

Physical Properties of Sprue

Thickness: 1.0 mm

Production of Casting

A gating system as shown in FIG. 2 was assembled using the sprue obtained in Example 1. A casting mold was set up using the gating system. A molten metal (1400° C.) was poured from the pouring cup.

Evaluation of Sprue After Casting

Neither blowback in the pouring cup nor vigorous flaming from the flow-off was observed. After casting, the mold was broken to find the sprue covering the solidified metal neatly. The sprue was easily removed by blasting.

As described, it was confirmed that the sprue (part for casting) obtained in Example 1 was prevented from thermal shrinkage accompanying thermal decomposition and was excellent in handling properties.

INDUSTRIAL APPLICABILITY

The present invention provides a part for casting that is prevented from thermal shrinkage accompanying thermal decomposition and is excellent in handling properties; a process of producing the part; and a method for casting production using the part.

The invention claimed is:

1. A part for casting, into which a molten metal is poured, comprising base paper for paper tubing and containing an organic fiber, a carbon fiber for reducing thermal shrinkage, and binder, the base paper being spiral-wound into a tube such that the base paper is wound with an overlap between adjacent turns and a plurality of base papers are wound one on top of another, the total content of carbon fiber being 7 to 80 parts by weight of the base paper, and the total weight of the organic fiber, the carbon fiber, and the binder being taken as 100 parts weight; wherein the binder comprises an organic binder.

2. The part for casting according to claim 1, comprising 10 to 70 parts by weight of the organic fiber, 7 to 80 parts by weight of the carbon fiber, and at least 10 parts by weight of the binder, the total weight of the organic fiber, the carbon fiber, and the binder being taken as 100 parts by weight.

3. The part for casting according to claim 1, wherein the binder comprises at least two binders having different melting points.

4. The part for casting according to claim 1, wherein the binder consists of an organic binder and an inorganic binder.

5. The part for casting according to claim 4, wherein the inorganic binder is a compound mainly comprising $SiO_2$.

6. The part for casting according to claim 1, wherein the organic fiber is paper fiber.

7. A method for casting production comprising burying the part for casting according to claim 1 in casting sand.

8. A process of producing a part for casting according to claim 1, comprising the steps of making base paper for paper tubing by papermaking using a slurry containing at least the organic fiber and the carbon fiber, converting the base paper into a spiral-wound paper tube by winding the base paper in a helix pattern such that the base paper is wound with an overlap between adjacent turns and a plurality of base papers are wound one on top of another, and incorporating the binder into the paper tube.

9. The process of producing a part for casting according to claim 8, wherein the step of incorporating the binder into the paper tube is impregnation.

10. The process of producing a part for casting according to claim 9, wherein the slurry further contains an inorganic binder.

* * * * *